US006830269B1

(12) United States Patent
Mayle

(10) Patent No.: US 6,830,269 B1
(45) **Date of Patent: *Dec. 14, 2004**

(54) APPARATUS AND METHOD FOR SEALING A VERTICAL PROTRUSION ON A ROOF

(76) Inventor: Robert L. Mayle, 2047 Hyde Rd., Port Clinton, OH (US) 43452

( * ) Notice: Subject to any disclaimer, the term of this patent is extended or adjusted under 35 U.S.C. 154(b) by 13 days.

This patent is subject to a terminal disclaimer.

(21) Appl. No.: 10/435,866

(22) Filed: May 12, 2003

Related U.S. Application Data

(63) Continuation of application No. 09/302,661, filed on Apr. 30, 1999, now Pat. No. 6,588,801.
(60) Provisional application No. 60/083,682, filed on Apr. 30, 1998.

(51) Int. Cl.[7] ..... E04B 5/48
(52) U.S. Cl. ..... 285/42; 52/58; 285/43
(58) Field of Search ..... 285/42, 43, 44; 52/58

(56) References Cited

U.S. PATENT DOCUMENTS 549,352 A * 11/1895 Felger ..... 285/43
821,426 A * 5/1906 Meyer ..... 24/280
1,012,219 A * 12/1911 Overton ..... 285/44
1,031,577 A * 7/1912 Overton ..... 285/44
1,080,159 A * 12/1913 Overton ..... 285/43
1,103,666 A * 7/1914 Fife ..... 285/13
1,195,338 A * 8/1916 Churchill ..... 285/44
1,540,192 A * 6/1925 Smith ..... 285/13
1,594,932 A * 8/1926 Doyle ..... 285/43
1,678,715 A * 7/1928 Stephenson ..... 285/44
1,721,715 A * 7/1929 Schindler ..... 285/43
3,763,605 A * 10/1973 Freeman ..... 52/58
3,871,145 A * 3/1975 Hatmaker ..... 52/60
4,112,632 A * 9/1978 Simpson ..... 52/11
4,603,517 A * 8/1986 Lyons, Jr. ..... 52/60
4,625,469 A * 12/1986 Gentry et al. ..... 52/3
4,635,409 A * 1/1987 Vandemore ..... 52/60
4,671,036 A * 6/1987 Sullivan ..... 52/518
4,799,986 A * 1/1989 Janni ..... 156/196
4,860,514 A * 8/1989 Kelly ..... 52/410
4,870,796 A * 10/1989 Hart et al. ..... 52/409
4,872,296 A * 10/1989 Janni ..... 52/58
5,027,572 A * 7/1991 Purcell et al. ..... 52/309.9
5,077,943 A * 1/1992 McGady ..... 52/58
5,365,709 A * 11/1994 Lassiter ..... 52/408
5,452,553 A * 9/1995 Clapp et al. ..... 52/408

* cited by examiner

*Primary Examiner*—Eric K. Nicholson
(74) *Attorney, Agent, or Firm*—Standley Law Group LLP

(57) ABSTRACT

A pipe boot having a vertical portion adapted to surround a predetermined portion of the pipe to be covered, the vertical portion having a top end and a bottom end, wherein the top end has a top opening and wherein the bottom end has a bottom opening; a base portion, wherein the base portion is connected to a bottom edge of the vertical portion and wherein the vertical portion extends substantially in the vertical direction when the base portion resides on the roof. It is also preferred that the bottom opening of the boot be adapted to accept a pipe to be covered. In the preferred embodiment, the top end of the vertical portion has a slit, the slit running vertically down a predetermined distance of the vertical portion of the boot and wherein the slit allows the top opening of the vertical portion to be adjusted in size to fit around the pipe to be covered. The boot is installed by: placing the bottom opening of the vertical portion over a protrusion to be covered; placing the base portion flat over the roof; pulling a top portion of a side edge of the vertical portion around the pipe so that the top opening of the vertical portion is adjusted to fit the pipe; and sealing the top opening of the vertical portion around the pipe.

16 Claims, 2 Drawing Sheets

APPARATUS AND METHOD FOR SEALING A VERTICAL PROTRUSION ON A ROOF

This application is a continuation of U.S. patent application Ser. No. 09/302,661, filed Apr. 30, 1999 now U.S. Pat. No. 6,588,801, which claims the benefit of U.S. Provisional Application Ser. No. 60/083,682, filed Apr. 30, 1998, both of which are incorporated herein by reference.

BACKGROUND OF THE INVENTION

The present invention relates generally to roof-covering devices, and more particularly to a boot for covering and providing a water-tight seal around a vertical protrusion in a roof.

Polymer coated membranes are commonly used to cover roofs. Often, the membrane is custom designed for the particular roof on which it is used. The roof measurements are provided to the factory which creates a unitary membrane from separate pieces which have been heat welded together.

Although these roofs are generally flat, there are frequently items protruding from the surface of the roof, such as vents, ductwork, air conditioning units, and the like. The size and locations of these items must also be provided to the factory so that accommodations can be made for them in the membrane.

The present invention specifically relates to a boot for covering and sealing a vertical protrusion (e.g., pipe) extending from a roof to be sealed. More specifically, the present invention is comprised of a boot having a slit in the top portion of the boot allowing the boot to be easily adjusted to seal vertical protrusions of various sizes.

As discussed, when installing a roof membrane, it is desirable to provide a water-tight seal around protrusions in a roof. When installing a boot around a protruding pipe, generally three seals must be made to provide a water-tight seal around the pipe:

1.) a base portion of the boot should be sealed to a vertical portion of the boot (e.g. heat sealed);

2.) the base portion should be sealed to the roof or a roof membrane(e.g. heat sealed); and 3.) a top portion of the vertical portion of the boot should be sealed around the pipe to prevent water from entering any space between the boot and the pipe.

Currently this process of sealing a protruding pipe takes a relatively long time and oftentimes results in a poor seal. Accordingly, the present invention relates to a new method and apparatus for sealing vertical protrusions from a roof wherein predetermined portions of the boot are sealed together off-site resulting in a pipe boot having a slit in the top portion of the vertical portion of the boot allowing the boot of the present invention to be easily installed and adjusted to provide a tight seal for protruding pipes of various diameters.

The boot of the present invention:

1.) allows easier and more cost-effective installation;

2.) allows sealing of pipes of various diameters; and

3.) provides tight seals to pipes of various diameters.

SUMMARY OF THE INVENTION

In addition to the features mentioned above, objects and advantages of the present invention will be readily apparent upon a reading of the following description.

The boot of the present invention is preferably comprised of: a vertical portion adapted to surround a predetermined portion of the pipe to be covered, the vertical portion having a top end and a bottom end, wherein the top end has a top opening and wherein the bottom end has a bottom opening; a base portion, wherein the base portion is connected to a bottom edge of the vertical portion and wherein the vertical portion extends substantially in the vertical direction when the base portion resides on the roof. It is also preferred that the bottom opening of the boot be adapted to accept a pipe to be covered. In the preferred embodiment, the top end of the vertical portion has a slit, the slit running vertically down a predetermined distance of the vertical portion of the boot and wherein the slit allows the top opening of the vertical portion to be adjusted in size to fit around the pipe to be covered.

The boot of the present invention is preferably formed by: providing a first piece of material having a first side edge and a second side edge; forming a vertical portion having a bottom and top opening and a slit portion at a top end of the vertical portion, said vertical portion formed by sealing a bottom portion of the first side edge to a corresponding bottom portion of the second side edge; providing a base portion; and sealing a bottom edge of the vertical portion with the base portion so that the vertical portion is substantially vertical with respect to the base portion when the base is in the flat horizontal position.

The boot is then installed by: placing the bottom opening of the vertical portion over a protrusion to be covered; placing the base portion flat over the roof; pulling a top portion of a side edge of the vertical portion around the pipe so that the top opening of the vertical portion is adjusted to fit the pipe; and sealing the top opening of the vertical portion around the pipe.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAILED DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
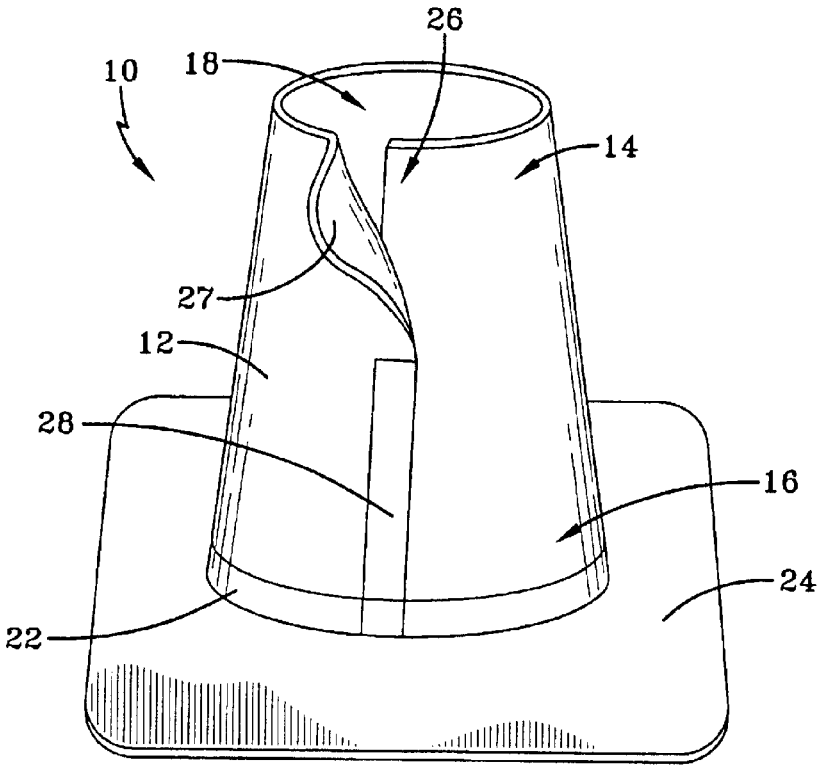
FIG. 1 illustrates one embodiment of the boot of the present invention.

FIG. 1 illustrates one embodiment of the boot 10 of the present invention. In the preferred embodiment, the boot 10 of the present invention is adapted to seal pipes protruding from a roof. In the preferred embodiment, the pipe boot of the present invention is comprised of:

a vertical portion 12 adapted to surround a predetermined portion of the pipe to be covered, the vertical portion having a top end 14 and a bottom end 16, wherein the top end 14 has a top opening 18 and wherein the bottom end has a bottom opening 20; and a base portion 24, wherein the base portion 24 is connected to a bottom edge 22 of the vertical portion 12 and wherein the vertical portion 12 extends substantially in the vertical direction when the base portion 24 resides on the roof.

In the preferred embodiment, the top end 14 of the vertical portion 12 has a slit 26, the slit running vertically down a predetermined distance of the vertical portion 12 of the boot 10 and wherein the slit 26 allows the top opening 18 of the vertical portion 12 to be adjusted in size to fit around the pipe to be covered. It is preferred that the slit 26 extend at least 2 inches from a top edge 23 of the vertical portion 12 to allow flexibility for the top opening 18 to be adjusted in size. The top opening 18 may be made smaller by pulling on the "flap" portion 27 of the vertical portion around the pipe. ("Flap" in this instance merely refers to a portion of the vertical portion 12 around the portion of the side edge 36 that is not sealed.)

Figure 2:
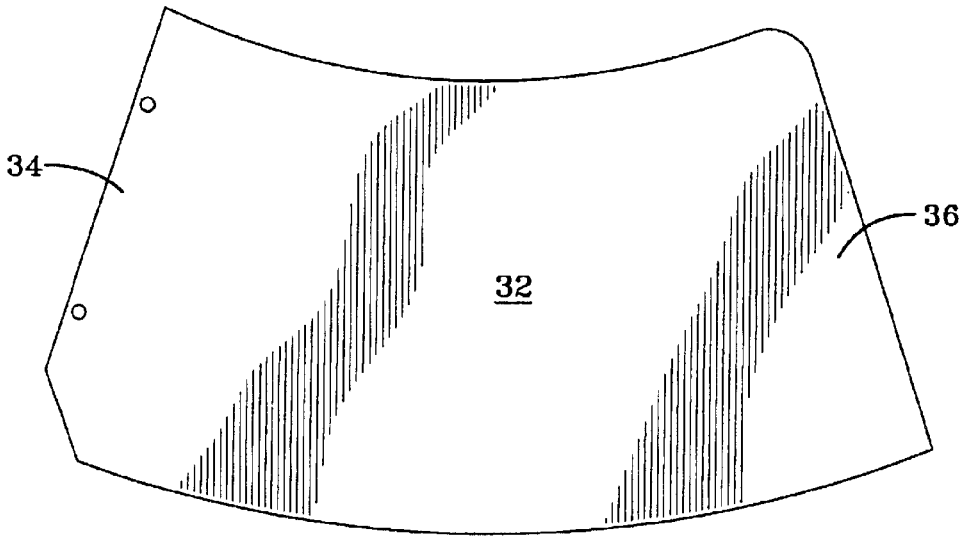
FIG. 2 illustrates one embodiment of an unassembled vertical portion of the boot of FIG. 1.
Figure 3:
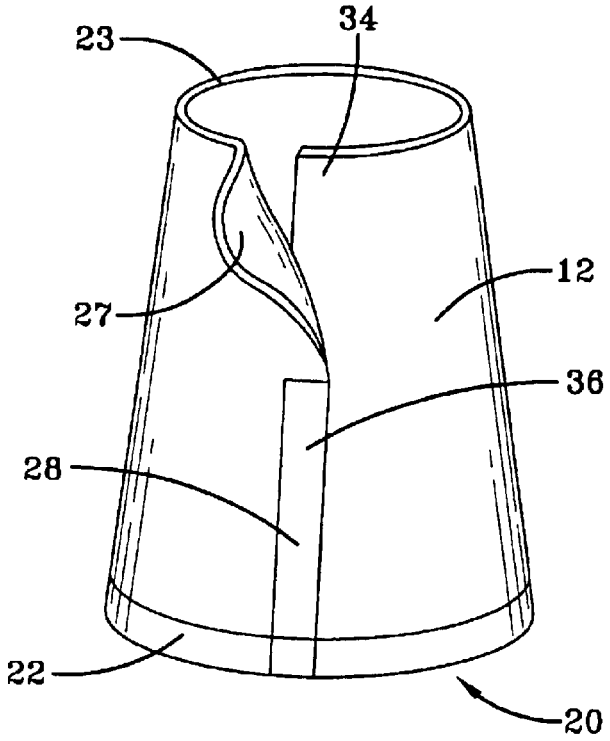
FIG. 3 illustrates one embodiment of an assembled vertical portion of the boot of FIG. 1.

FIG. 2 illustrates one embodiment of an unassembled vertical portion 32 of the boot 10 of FIG. 1. The unassembled vertical portion 32 has a first side edge 34 and a second side edge 36. A conical shaped vertical portion is formed from the unassembled vertical portion 32 when the first side edge 34 and the second side edge 36 are sealed together (see FIG. 3). In the preferred embodiment, the first side edge 34 is heat welded to the second side edge 36 forming a heat welded section 28 on the vertical portion 12. The first and second side edges 34, 36 of the vertical portion 12 are heat welded along a predetermined portion of the bottom end 16 of the vertical portion 12 and wherein the unattached sections of the first and second side edges 34, 36 form the slit 26. FIG. 3 illustrates one embodiment of an assembled vertical portion 12 of the boot of FIG. 1. As the vertical portion 12 is cone shaped, the top 18 opening is smaller than the bottom opening 20.

Figure 4:
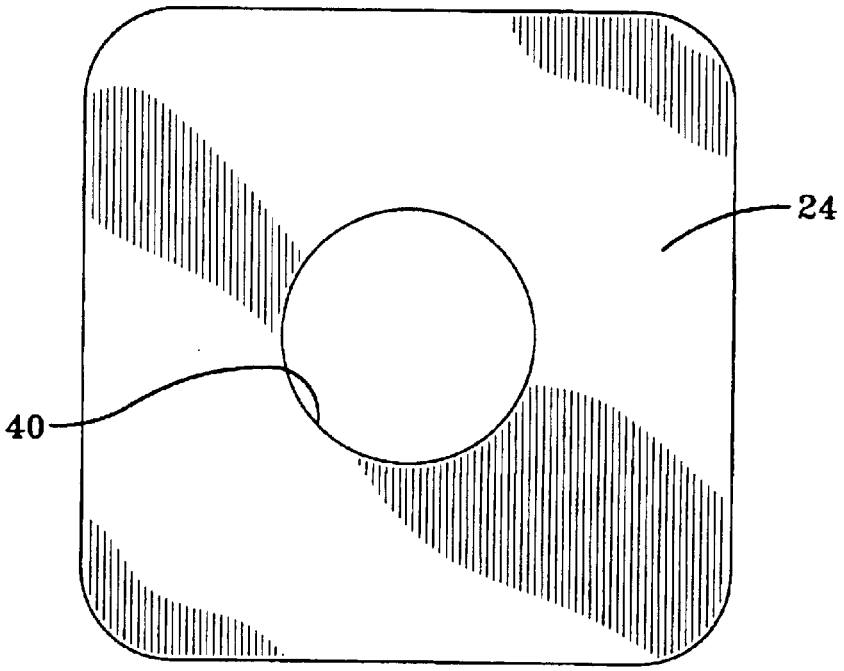
FIG. 4 illustrates one embodiment of a base portion of the boot of FIG. 1.

FIG. 4 illustrates one embodiment of a base portion 24 of the boot of FIG. 1. The base portion 24 is heat welded to the bottom edge 22 of the vertical portion 12. In the preferred embodiment, the base portion 24 is heat welded to the bottom edge 22 of the vertical portion 12. The base portion 24 and vertical portion 12 may be formed together using dies (e.g. female and male counterpart dies where the male part is a cylindrical shaped piece for forming the vertical portion 12 around the base portion 24).

The boot 10 of the present invention is preferably made by first providing an unassembled vertical portion 32 having a first side edge 34 and a second side edge 36. The vertical portion 12 is formed by sealing a bottom portion of the first side edge 34 to a corresponding bottom portion of the second side edge 36. This seal is shown at 28. The vertical portion 12 has a slit 26 at a top end 14 of the vertical portion 12 and a bottom and top opening 18, 20.

Next a base portion 24 is sealed to the bottom edge 22 of the vertical portion 12. In the preferred embodiment, the base portion 24, is a sheet of predetermined size having an opening 40 corresponding to the bottom opening 20 of the vertical portion 12. It is preferred that the material be of a composition that lends itself to heat welding. In this embodiment, the opening 40 in the base portion 24 is aligned with the bottom opening 20 of the vertical portion 12 and the edge of the opening 40 in the base portion 24 is sealed to the bottom edge 22 of the vertical portion 12.

In the preferred embodiment, the vertical portion 12 is substantially vertical with respect to the base portion 24 when the base portion 24 is in the flat horizontal position (e.g. on the roof substrate).

The boot 10 of the present invention is installed by placing the bottom opening 20 of the vertical portion 12 over the protrusion (e.g. pipe) to be covered. The top opening 18 of the vertical portion 12 should not be higher than the top of the protrusion. The base portion 24 is then placed flat over the roof.

Next, the top portion of the side edge 36 (e.g. the flap portion 27) of the vertical portion 12 is pulled around the pipe so that the top opening 18 is adjusted to fit the diameter of the pipe. The top opening 18 of the vertical portion 12 is then sealed around the pipe. In the preferred embodiment, the top portion of the side edge (e.g. the flap portion 27) is heat sealed to the corresponding top portion of the other side edge 34, on site. The base portion 24 is then heat sealed to the underlying roofing membrane to provide a water-tight seal around the protrusion.

The boot 10 of the present invention allows for easier and more cost-effective manufacture and installation and allows for the water-tight sealing of pipes of various diameters.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. A method for covering a vertical protrusion on a roof, comprising the steps of:

providing a first piece of material having a first side edge and a second side edge;

forming a vertical portion having a bottom end and a slit portion at a top end of said vertical portion, said vertical portion formed by sealing a portion of said first side edge at said bottom end to a corresponding portion of said second side edge at said bottom end;

placing said vertical portion over said vertical protrusion by passing said vertical protrusion through said bottom end of said vertical portion;

overlapping said first side edge and said second side edge along said slit portion of said vertical portion to fit a first perimeter of said vertical protrusion along at least a portion of said vertical portion; and sealing said slit portion by a means of field welding.

2. The method of claim 1, wherein said step of sealing said slit portion is performed using a means of field welding selected from the group consisting of dielectric welding, hot air bonding, solvent fusion, adhesive bonding, melted bonding, vibration welding, ultrasonic welding, and heat staking.

3. The method of claim 1, further comprising the step of:

sealing said bottom end of said vertical portion to a roof.

4. The method of claim 3, wherein said step of sealing said bottom end of said vertical portion to a roof is performed using a means selected from the group consisting of dielectric welding, hot air bonding, solvent fusion, adhesive bonding, melted bonding, vibration welding, ultrasonic welding, and heat staking.

5. The method of claim 1, further comprising the steps of:

providing a base portion comprised of a second piece of material having an opening defined by a second perimeter, wherein said second perimeter is longer that said first perimeter;

aligning said bottom end of said vertical portion with said opening in said base portion so that said vertical portion is substantially vertical with respect to said base portion when said base portion is in a flat horizontal position; and sealing said bottom end of said vertical portion to said base portion.

6. The method of claim 5, wherein said step of sealing said bottom end of said vertical portion to said base portion is performed using a means selected from the group consisting of dielectric welding, hot air bonding, solvent fusion, adhesive bonding, melted bonding, vibration welding, ultrasonic welding, and heat staking.

7. The method of claim 5, further comprising the step of sealing said base portion to a roof.

8. The method of claim 7, wherein said step of sealing said base portion to a roof is performed using a means selected from the group consisting of dielectric welding, hot air bonding, solvent fusion, adhesive bonding, melted bonding, vibration welding, ultrasonic welding, and heat staking.

9. A boot for covering a vertical protrusion on a roof, comprising:

a vertical portion, said vertical portion having a top opening with a first side edge and a second side edge and a bottom opening, said vertical portion having a slit at the top end, said slit allowing said first side edge and said second side edge to be wrapped and overlapped to fit around at least a portion of said vertical protrusion to be sealed; and a base portion having a base opening aligned with said bottom opening of said vertical portion, wherein said base portion is sealed to said vertical portion so that said vertical portion is substantially vertical with respect to said base portion when said base portion is in a flat horizontal position; and wherein said overlapped said first side edge and said second side edge are field welded in order to form a tight seal around said vertical protrusion.

10. The boot of claim 9 wherein said vertical portion and said base portion are comprised of a thermoplastic olefin (TPO) material.

11. The boot of claim 9 wherein said vertical portion and said base portion are comprised of a polyvinyl chloride (PVC) material.

12. The boot of claim 9 wherein said vertical portion and said base portion are made a heat bondable material.

13. The boot of claim 9 wherein said vertical portion and said base portion are made a glue bondable material.

14. The boot of claim 9 wherein said vertical portion and said base portion are made a solvent bondable material.

15. The boot of claim 9 wherein said vertical portion and said base portion are made a material comprised of rubber.

16. The boot of claim 9 wherein said vertical portion and said base portion are made a roofing material.

* * * * *

UNITED STATES PATENT AND TRADEMARK OFFICE

CERTIFICATE OF CORRECTION

PATENT NO. : 6,830,269 B1
DATED : December 14, 2004
INVENTOR(S) : Mayle

It is certified that error appears in the above-identified patent and that said Letters Patent is hereby corrected as shown below:

Title page,
Item [56], References Cited, U.S. PATENT DOCUMENTS, please delete “Felger” and insert -- Folger --.

Column 4,
Line 66, please delete “longer that” and insert -- longer than --.

Column 6,
Lines 20, 22, 24, 26 and 28, please delete “made a” and insert -- made of a --.

Signed and Sealed this

Twelfth Day of April, 2005

JON W. DUDAS
*Director of the United States Patent and Trademark Office*